United States Patent [19]

Dove et al.

[11] Patent Number: 4,557,616

[45] Date of Patent: Dec. 10, 1985

[54] RESISTIVE RIBBON THERMAL TRANSFER PRINTING SYSTEM AND PROCESS

[75] Inventors: Derek B. Dove, Mount Kisco, N.Y.; Claus D. Makowka, Pembroke Pines, Fla.; Ramon L. Street, San Jose, Calif.

[73] Assignee: International Business Machines Corporation, Armonk, N.Y.

[21] Appl. No.: 561,010

[22] Filed: Dec. 12, 1983

[51] Int. Cl.[4] ..... B41J 3/04

[52] U.S. Cl. ..... 400/120; 400/241.1; 400/241.4

[58] Field of Search ..... 400/120, 241, 241.1, 400/241.4

[56] References Cited

U.S. PATENT DOCUMENTS

| | | | |
|---|---|---|---|
| 2,699,244 | 1/1955 | Markes | 400/241.4 |
| 2,849,096 | 8/1958 | Markes | 400/241.4 |
| 3,079,604 | 2/1963 | Schwarzer | 346/136 |
| 3,162,290 | 12/1964 | Knight | 400/241.4 |
| 3,596,055 | 7/1971 | Elston | 400/120 X |
| 3,632,969 | 1/1972 | Walkow | 400/120 X |
| 3,632,970 | 1/1972 | Walkow et al. | 400/120 X |
| 3,878,782 | 4/1975 | Coffelt | 101/235 |
| 4,063,500 | 12/1977 | Abe | 101/25 |
| 4,243,334 | 1/1981 | Shigemori | 400/241.4 X |
| 4,309,117 | 1/1982 | Chang et al. | 400/241 |
| 4,329,071 | 5/1982 | Applegate | 400/120 |

OTHER PUBLICATIONS

K. Kitamura, "Thermal Display Printer", IBM Technical Disclosure Bulletin, p. 2189, vol. 16, No. 7, Dec. 1973.

C. V. Wilbur, "Resistive Ribbon Printing of Typewriter Keys", IBM Technical Disclosure Bulletin, vol. 20, No. 12, May 1978, p. 5314.

T. C. Clarke et al., "Integrated Polyacetylene Structure for Resistive Ribbon Thermal Transfer Printing", IBM Technical Disclosure Bulletin, vol. 21, No. 12, May 1979, p. 5011.

W. Crooks et al., "Resistive Ribbon Ink Layers", IBM Technical Disclosure Bulletin, vol. 22, No. 2, Jul. 1979, p. 782.

W. Crooks et al., "Resistive Ribbon Thermal Transfer Printing Method", IBM Technical Disclosure Bulletin, vol. 19, No. 11, Apr. 1977, p. 4396.

*Primary Examiner*—Ernest T. Wright, Jr.

*Attorney, Agent, or Firm*—John J. Goodwin

[57] ABSTRACT

A technique and structure for resistive ribbon thermal transfer printing including a separate resistive ribbon and transfer ribbon therefor is illustrated. The resistive ribbon is used only for the generation of heat and is placed in contact with a separate transfer ribbon including a very thin carrier ribbon coated with ink. A moveable electrode printhead generates a heat pattern along the resistive ribbon and this pattern is compressed along the direction of printing by means of printhead motion $v_1$. The resistive ribbon is moved relative to the transfer ribbon at a velocity $v_2$ so as to generate a heat flow in the transfer ribbon corresponding to the pattern required for normal printing. The ink is melted and is transferred from the transfer ribbon to the paper.

4 Claims, 1 Drawing Figure

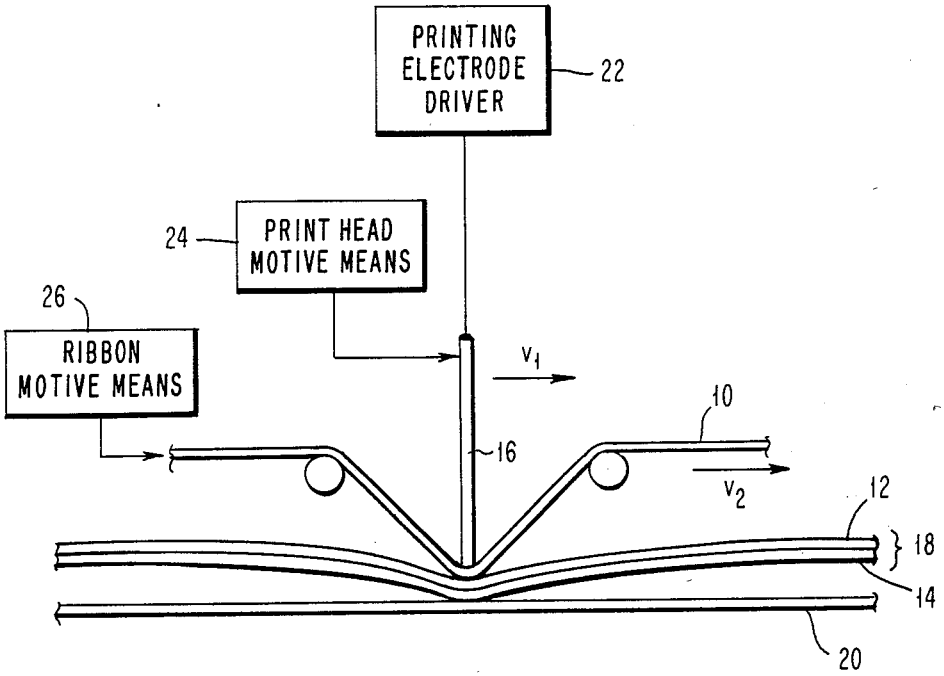
PRINTING ELECTRODE DRIVER
22
24
PRINT HEAD MOTIVE MEANS
26
RIBBON MOTIVE MEANS
$v_1$
10
16
$v_2$
12
18
14
20

RESISTIVE RIBBON THERMAL TRANSFER PRINTING SYSTEM AND PROCESS

BACKGROUND OF THE INVENTION

1. Field of the Invention

The present invention relates to thermal transfer printing and more particularly a thermal transfer printer structure including a separate resistive ribbon and transfer ribbon and to a technique for moving the resistive ribbon on the transfer ribbon.

2. Description of the Prior Art

Resistive ribbon thermal transfer printing is a form of electro-thermal printing. Representative prior art references in this technology include U.S. Pat. No. 4,309,117 issued Jan. 5, 1982 to Chang et al entitled RIBBON CONFIGURATION FOR RESISTIVE RIBBON THERMAL TRANSFER PRINTING which describes an apparatus which has an improved ribbon configuration containing a two-ply resistive element positioned on a conductive element.

U.S. Pat. No. 4,329,071 issued May 11, 1982 to Applegate et al entitled CURRENT COLLECTOR FOR RESISTIVE RIBBON PRINTERS describes a printer with a ribbon having a central conducting layer covered on one side by a resistive layer that receives electrical printing currents and on the other side by a thermally transferrable ink layer.

Other references in this technology include the following publications.

IBM Technical Disclosure Bulletin, "Thermal Display Printer", Kitamura, vol. 16, No. 7, December 1973, p. 2189.

IBM Technical Disclosure Bulletin, "Resistive Ribbon Thermal Transfer Printing Method", Crooks et al., vol. 19, No. 11, April 1977, p. 4396.

IBM Technical Disclosure Bulletin, "Resistive Ribbon Printing of Typewriter Keys", Wilbur, vol. 20, No. 12, May 1978, p. 5314.

IBM Technical Disclosure Bulletin, "Integrated Polyacetylene Structure for Resistive Ribbon Thermal Transfer Printing", Clarke et al., vol. 21, No. 12, May 1979, p. 5011.

IBM Technical Disclosure Bulletin, "Resistive Ribbon Ink Layers", Crooks et al., vol. 22, No. 2, July 1979, p. 782.

Features of the present invention are that a resistive ribbon is used to supply heat to a thermal transfer ribbon to cause printing and that the resistive ribbon is moved on the transfer ribbon in the same direction but at a different velocity.

In U.S. Pat. No. 3,079,604 issued Feb. 26, 1963 to Schwarzer and entitled RECORDING SYSTEM an ink recorder for registering oscillations on a paper is described wherein the strip of paper which is the medium for the recording, is drawn by means of a conventional drive arrangement in a sharp angle across a knife edge. A strip having a layer of coloring matter, for example ordinary carbon paper, such as is used for making copies on a typewriter, serves as a medium for marking the recording medium and is also passed across the knife edge under the recording strip and preferably in the opposite direction, but in a nearly stretched condition, so that it slides past the recording strip while being slightly pressed against it. This is not a resistive ribbon thermal transfer printer system.

In U.S. Pat. No. 3,878,782 issued Apr. 22, 1975 to Coffelt and entitled IMPRINTING MACHINE AND METHOD OF OPERATION, a structure and process is described wherein work members, such as cartons or labels, or the like, which are to be printed are fed through the machine with the machine having a rotary printing head, preferably heated, and a transfer or printing ribbon disposed between the printing head and the workpiece. The printing head rotates continuously and is moved to and from imprinting position by a fluid cylinder. The advancing of the ribbon is synchronized with rotation of the head and takes place only when the printing head moves to printing position, thus conserving the ribbon and causing ribbon advance only when necessary. This is not a resistive ribbon thermal transfer printer system.

In U.S. Pat. No. 4,063,500 issued Dec. 20, 1977 to Abe and entitled ROTARY HOT-STAMPING APPARATUS, a system is described for imprinting characters on a continuous strip of plastics or other material by pressing heated type against a printing ribbon thereon, the strip is fed at constant speed over a platen in a direction opposite to the direction of travel of the printing ribbon from payoff reel to takeup reel. The type is mounted on a rotary type carrier over the platen for revolution in a direction in conformity with the traveling direction of the strip. While the heated type is being pressed against the superposed ribbon and strip over the platen, the ribbon is thereby transported a predetermined distance toward the payoff reel with the strip relative to the platen and, when subsequently released by the type, is pulled back the same distance toward the takeup reel by a spring-energized pullback lever. This also is not a resistive ribbon thermal transfer printer structure.

The prior art does not show a resistive ribbon thermal transfer recording system employing a separate resistive ribbon and separate thermal transfer ribbon wherein a printhead is moving at a first velocity relative to the paper and the resistive ribbon is moving at a different velocity in the same direction to cause the resistive ribbon to skid on the separate transfer ribbon to effect pattern compression printing.

SUMMARY OF THE INVENTION

An object of the present invention is to provide a resistive ribbon thermal transfer printing system and process wherein more efficient use of resistive ribbon is obtained.

Another object of the present invention is to provide a resistive ribbon thermal transfer printing system and process wherein a heated resistive ribbon is moved relative to a separate inked transfer ribbon.

A further object of the present invention is to provide a resistive ribbon thermal transfer printing system and process wherein a resistive ribbon generates a heat flow in a separate inked transfer ribbon corresponding to the pattern to be printed.

The foregoing and other objects, features and advantages of this invention will be apparent from the following more particular description of the invention, as illustrated in the accompanying drawing.

BRIEF DESCRIPTION OF THE DRAWING

The drawing shows a cross-sectional illustration of a resistive ribbon thermal transfer recording structure according to the principles of the present invention.

DISCLOSURE OF THE INVENTION

In prior art resistive ribbon thermal transfer structures, a printhead composed of a series of electrodes makes contact with a multilayer ribbon including a layer of resistive material and a layer of inked material. Current from the electrodes passes through the resistive layer portion to produce heat. The transfer layer portion is provided with an ink coating and the heat produced by the resistive layer causes the ink to melt and be transferred onto a printing surface. By selectively actuating appropriate electrodes of the printhead, the pattern of heating and resultant melted ink can be controlled to form desired characters.

One type of electro-thermal printer relies on selective current applications to one or more printhead members that each include a resistive section which becomes heated and produces marks on heat sensitive paper.

Another type of electro-thermal printer uses similar resistive printhead members to locally heat a ribbon coated with thermally transferable ink to cause the transfer of ink to a receiving medium.

For a further type of electro-thermal printing, sometimes called electroerosion printing, a conducting layer is provided at an outer surface of the receiving medium and localized currents applied by printhead electrodes cause a vaporization of the conducting layer that leaves a visible mark.

Yet another type of electro-thermal printing employs a ribbon that has a thermally transferable ink on one outer surface and an electrically conducting layer on the other outer surface. Printing currents applied to the conducting layer cause localized conducting layer vaporization and resultant heating which results in ink transfer to mark a receiving medium.

A significant problem with resistive ribbon thermal printers is that the resistive ribbons are costly, it is desirable that the usage capability of the resistive ribbons be extended.

One technique known in the art, prints compressed characters upon the ribbon and moves the ribbon over the paper during printing so as to stretch the molten ink to form characters of normal width. This technique, however, requires the development of special ink to avoid smearing and has yet to be perfected.

In the present invention, an improved method is provided for achieving printing of characters using a compressed pattern on the resistive ribbon which is moved relative to a separate transfer ribbon.

The technique and structure therefor is illustrated in the drawing. The resistive ribbon 10 is used only for the generation of heat and is placed in contact with a separate very thin carrier ribbon 12 coated with ink 14, the combination of the ink and carrier layer being referred to as the transfer ribbon 18. At least one moveable electrode printhead 16 generates a heat pattern along the resistive ribbon 10 when selectively energized by the printing electrode driver 22. This pattern is compressed along the direction of printing by means of printhead motion $v_1$ imparted by printhead motion means 24. The resistive ribbon 10 is moved relative to the transfer ribbon 18 at a velocity $v_2$ by ribbon motive means 26 so as to generate a heat flow in the transfer ribbon 18 corresponding to the pattern required for normal printing. The ink 14 is melted and is transferred from the transfer ribbon 18 to paper 20.

The printing speed is determined by the printhead 16 velocity $v_1$ relative to the paper 20. The resistive ribbon 10 is moved at a smaller velocity $v_2$ causing it to skid over the carrier layer 12. In this way, for example, four inches of printing may require four inches of transfer ribbon 18 but only one inch of the expensive resistive ribbon 10 is used. Thus, less resistive ribbon is used for a given number of characters than is needed in the prior art.

It is well known to those skilled in the art that printheads and resistive-thermal ribbons can be moved by mechanical and electromechanical drive means. Since a large selection of varied means are available in the art for moving printhead 16 at velocity $v_1$ and resistive ribbon 10 at velocity $v_2$, an embodiment of motive means mechanism 24 and 26 has not been included in the drawing in the interests of simplicity since the particular drive mechanism is state-of-the-art and does not constitute a specifically novel feature of the present invention.

Another advantage of the invention is that a simple ink may be used without smearing due to relative motion between the ink carrier and the paper. The result is that total ribbon cost is reduced.

With a thin transfer ribbon, for example, 0.1 mil nylon, high print speed can be achieved.

For example, it has been found that printing rates of several inches/sec may be achieved using a resistive ribbon consisting of carbon black containing poly-carbonate material and a transfer ribbon consisting of approximately 5 micrometers thickness of polyester or similar material.

If necessary, a lubricant layer may be used to enhance thermal transfer and to control friction between the ribbons.

By making it possible to use a separate transfer ribbon, a much wider choice of inks is available. Multicolor can then be achieved by utilizing several different color transfer ribbons. All would be used with the same resistive layer ribbon. Multicolor printing can also be achieved by using transfer ribbons containing bands or regions of different color inks, and by means of mechanical motion, separate desired ones of the bands or regions of the transfer ribbon can be selected for printing. The present invention may also be employed with print heads of a variety of widths, for example, with print heads for printing a line of characters in sequence across a page or with print heads having the width of a page for creating characters by printing an entire line at one time and then moving down the page. Also other special purpose transfer ribbons and inks can be used without redesigning the separate resistive master ribbon. In one form, the resistive layer may be reusable in the form of an endless loop or other shape, so effecting a further savings of resistive layer material.

Having thus described our invention, what we claim as new, and desire to secure by Letters Patent is:

1. A resistive ribbon thermal transfer printing system comprising at least one movable printhead electrode, an electrically conductive movable resistive ribbon in slidable contact with said at least one movable printhead electrode for generating heat in response to said at least one printhead electrode, and a separate ink transfer ribbon containing a coating of ink and being in slidable contact with said resistive ribbon, and means for moving said at least one movable printhead electrode at a velocity $v_1$ relative to and in the same direction as said ink transfer ribbon and means for moving said movable resistive ribbon at a velocity $v_2$ relative to and in the same direction as said separate transfer ribbon, such that said resistive ribbon moves relative to and simultaneously with said at least one printhead electrode.

2. A resistive ribbon thermal transfer printing system according to claim 1 wherein said moving resistive ribbon generates a heat flow to said ink transfer ribbon in response to electrical conduction from said at least one moving printhead electrode, and wherein said ink on said ink transfer ribbon melts in response to said heat flow sufficient for transfer to a print medium.

3. A resistive ribbon thermal transfer printing system according to claim 2 wherein said at least one moving printhead electrode produces a heat flow in said resistive ribbon corresponding to a character pattern having a first dimension and wherein said relative movement between said resistive ribbon and said ink transfer ribbon produces melted ink corresponding to a character pattern having an elongated second dimension greater than said first dimension.

4. A process for printing with a resistive ribbon thermal printing system having at least one movable printhead electrode, a movable resistive ribbon and a separate ink transfer ribbon comprising the steps of moving said at least one movable printhead electrode relative to and in the same direction as said ink transfer ribbon at a first velocity, moving said resistive ribbon relative to and in the same direction as ink transfer ribbon at a second velocity wherein said printhead electrode and said resistive ribbon move simultaneously in the same direction at a relative velocity between said first and second velocity.

* * * * *